US009700467B2

(12) United States Patent
Capilla

(10) Patent No.: US 9,700,467 B2
(45) Date of Patent: Jul. 11, 2017

(54) INTRAHOSPITAL VEHICLE FOR TRANSPORT AND TRANSFER OF OBESE PATIENTS

(71) Applicant: Jorge Horacio Capilla, Olavarría (AR)

(72) Inventor: Jorge Horacio Capilla, Olavarría (AR)

( * ) Notice: Subject to any disclaimer, the term of this patent is extended or adjusted under 35 U.S.C. 154(b) by 0 days.

(21) Appl. No.: 15/133,981

(22) Filed: Apr. 20, 2016

(65) Prior Publication Data

US 2016/0310337 A1 Oct. 27, 2016

(30) Foreign Application Priority Data

Apr. 23, 2015 (AR) ..... P150101220

(51) Int. Cl.
*A61G 7/10* (2006.01)
*A61G 1/02* (2006.01)
*A61G 7/002* (2006.01)

(52) U.S. Cl.
CPC ..... *A61G 1/02* (2013.01); *A61G 7/1019* (2013.01); *A61G 7/1046* (2013.01); *A61G 7/1055* (2013.01); *A61G 7/002* (2013.01); *A61G 2200/16* (2013.01)

(58) Field of Classification Search
CPC .. A61G 7/1013; A61G 7/1015; A61G 7/1017; A61G 7/1019; A61G 5/00; A61G 5/08; A61G 1/02; A61G 7/1046; A61G 7/1055; A61G 7/002; A61G 22/16
USPC ..... 280/47.34, 640, 657
See application file for complete search history.

(56) References Cited

U.S. PATENT DOCUMENTS 1,588,573 A * 6/1926 Edmiston ..... A61G 7/1015 5/302
5,068,931 A * 12/1991 Smith ..... A61G 7/1015 5/84.1
6,006,376 A * 12/1999 Williamson ..... A61G 7/1015 5/81.1 R
2015/0182403 A1* 7/2015 Lim ..... A61G 7/1025 5/86.1

* cited by examiner

*Primary Examiner* — John Walters
(74) *Attorney, Agent, or Firm* — Fay Sharpe LLP; James E. Scarbrough

(57) ABSTRACT

An intrahospital vehicle for transport and transfer of obese patients designed to take a bedridden obese patient, lift the patient up and then lay the patient down onto a receiving stretcher to transfer the patient within a hospital, so that, once the target location has been reached, the patient may be transferred to an operating table, X-ray table, intensive care unit table or the like, and then transferred back to the receiving stretcher to return to the hospital bed. The vehicle includes a robust main rectangular base structure, mounted on wheels, a lower chassis formed by a rear crossbar and two side rails, from which four corner columns are projected.

10 Claims, 11 Drawing Sheets

INTRAHOSPITAL VEHICLE FOR TRANSPORT AND TRANSFER OF OBESE PATIENTS

CLAIM OF PRIORITY

This utility application claims the priority benefit of Argentina Patent Application No. AR P2015 01 01220, filed Apr. 23, 2015, the disclosure of which is incorporated herein by reference in its entirety.

FIELD OF THE DISCLOSURE

The main object of the present disclosure relates to an intrahospital vehicle for transport and transfer of obese patients, especially designed to take bedridden obese patients out of hospital beds, by lifting the patients up while they remain in the same position, and laying them down onto a receiving stretcher housed by the same vehicle in order to transfer the patients within the hospital along hallways and inside elevators to reach different rooms and laboratories of the health center and to place the patients onto operating or recovery tables, intensive care or coronary unit beds, emergency room tables, X-ray tables, etc., and placing the patients back onto their beds without the nurses, stretcher-bearers, physicians and even the patients themselves needing to make any effort, because patients will feel comfortable and safe and will be able to act passively and relaxed throughout transfer and transport maneuvers.

More particularly, the present disclosure includes a vehicle having a novel constructive and functional design with general dimensions suitable for moving around a Hospital, Clinic, or Health Center and great adaptability for the vehicle to be disposed over the bed and advance such that the patient, previously hold using a resistant sheet (usually named "lift sheet") can be vertically lifted without the need of human effort.

Having the patient already lifted and suitably supported, the vehicle of the present disclosure can be removed from its position over the bed, and the receiving stretcher can be placed horizontally to receive the patient to be transferred, who will be lowered and completely laid onto the stretcher, remaining on that plane so as to be transferred by a stretcher-bearer, in the same manner as a conventional hospital stretcher.

This is a novel vehicle based on electromechanical actuating means to perform the aforementioned movements necessary to lift patients in combination with their transfer to the above described receiving stretcher, which has to be horizontally placed so as to receive and hold the patient throughout the transfer process while keeping the ability to perform the same operation in another location in a safe, reassuring, simple, precise, noiseless, imperceptible, and very comfortable manner to obese patients, thus implying a useful tool that will be able to be suitably driven by means of a remote control to any hospital location.

It is of particular relevance that, when using the vehicle of the present disclosure, the need to have several caregivers lift a heavy obese patient in a supine position is completely eliminated, avoiding the need to make great efforts that can affect the bone and muscular structure of these caregivers and cause injuries and diseases normally affecting nurses and stretcher-bearers taking care of said hospitalized patients.

In order to perform the aforementioned operations, the vehicle of the present disclosure comprises a robust and novel main structure mounted on wheels characterized by being longer than a conventional hospital bed, one of its bigger side faces remaining open, which allows the vehicle to move transversely, enclosing the bed the patient is lying onto, and disposing its lifting means over the same.

The main structure supports the lift that consists of a special vertically sliding quadrangular frame designed to receive the "lift sheet" holding the patient, wherein said lift is connected to an actuator for raising and lowering the same by sliding on the columns of the main structure.

Likewise, the main structure houses on one of its side faces the receiving stretcher that is arranged to be mounted on sliders, through which it can slide from a side location, thus remaining on a vertical plane, to an intermediate height central location wherein it is placed on a horizontal plane being able to be steadily fixed to said structure by fixing bolts and receive the patient transferred to the stretcher when these are lowered with the lift.

Under the above-mentioned conditions, the nurse(s) will be able to place the lift sheet beneath the patient, then the stretcher-bearer will move the vehicle closer by transversely moving it until enclosing the bed. Once the bed has been enclosed, the stretcher-bearer will fit into the loops of the lift sheet the hooks that the vertically sliding quadrangular frame has for this purpose.

Accordingly, using a remote control, the stretcher-bearer will be able to control the raising and lowering movements, causing transfer of the patient from the bed to the vehicle optimally placing the patient onto the receiving stretcher and transporting the patient without any effort whatsoever.

Thus, there is a need for a vehicle consisting of a new combination of elements, designed to obtain a better result. Consequently, apart from being a novel disclosure, its constructive and functional design involves a clear inventive step in compliance with all the requirements established by law to be considered a patent disclosure.

BACKGROUND OF THE DISCLOSURE

It is well known that, at present, most of the obese patients admitted to Hospitals and Health Centers are not capable of moving on their own so they need to be transported in either special wheelchairs or stretchers inside the hospital rooms in order to access the different areas of diagnosis and treatment including surgical rooms.

For this purpose, it is customary procedure for specially trained caregivers, nurses, and stretcher-bearers to raise an obese patient of 300 kilograms or more by firstly placing the "lift sheet" beneath the patient's body. The lift sheet is just a piece of resistant and washable synthetic textile material with handgrips around the perimetric edge thereof.

Once the patient is placed onto the lift sheet, all the caregivers simultaneously proceed to execute maneuvers to move the patient until placing the patient onto the receiving transfer stretcher that is adjacently located. To this end, universal standards are followed, which in the case of very high weight obese patients require the presence of several especially trained nurses and stretcher-bearers standing around the bed, one at the foot and one at the head of the bed, and the rest of them on the side faces.

Some caregivers hold the handles or handgrips of the lift sheet, while the rest hold the patient's head and feet.

Once this action is completed, the order of transfer the patient is given so that, jointly and in unison, the patient is lifted, laterally moved and placed onto the adjacent stretcher.

As it may be observed, despite the willingness and expertise shown by the health care staff, this maneuver turns out to be an abrupt and rude maneuver seeing human effort limitation against weight and location of the patient to be transferred.

Once the patient is placed onto the stretcher, transfer takes place with the assistance of stretcher-bearers, one of them located at the front and the other at the end of the stretcher, which is moved from the room towards the halls and elevators until it reaches the area where the patient is subjected to diagnosis or treatment procedures (rays, tomography, orthopedics, etc.) or the surgical area where the above-mentioned maneuvers are performed again to place the patient onto the corresponding operating table.

Finally, once treatment of the patient has been completed, the patient must return to his/her room; therefore, the same transport and transfer operation as described above is required.

It may be asserted that so far no apparatus, device or equipment designed to carry out the same maneuvers that stretcher-bearers and nurses have to simultaneously perform to move obese patients is known.

Only some boards are known, these boards having perimetric handles, cranes, or ceiling-mounted tracks, which are not suitable for moving around the hospital.

All these cases are related to auxiliary equipment or means that are not suitable for performing synchronized work and effort necessary to transport and transfer a hospitalized obese patient.

SUMMARY OF THE DISCLOSURE

All the aforementioned problems are solved with the vehicle of the present disclosure because once the lift sheet is placed beneath the patient, the vehicle should only be located beside the bed such that the bed is enclosed and the lift is arranged over the same without any effort.

Then the stretcher-bearer or nurse will actuate the lift by means of the remote control in order to perform the movement maneuvers explained above.

In order to achieve the purposes and functions briefly described above, the vehicle of the present disclosure comprises a robust rectangular structure, mounted on wheels, said structure comprising a lower chassis formed with a rear crossbar or beam and two side rails defining a C-shaped lower chassis, which are spaced apart from each other at a distance longer than the length of a conventional hospital bed.

Projecting from the above-mentioned lower chassis, four corner columns are provided, said columns characterized by having a larger lower section that extends into a smaller upper section, thereby forming the respective vertical guides for movement of the lift.

Indeed, said lift comprises a vertically sliding quadrangular frame which in correspondence with its four corner vertices defines respective boxes carrying inner bearings that are supported and slide on said upper sections of the columns of the self-supporting structure.

The vertical movements of said quadrangular frame comprised by the lift are actuated with respective electrical linear actuators, the lifting means of which extend from a respective intermediate side rail of the self-supporting structure to the lower sides of said quadrangular frame.

Said linear actuators are actuated from a specific electromechanical circuit that may be controlled using a remote control to command raising or lowering of the quadrangular frame.

The vehicle of the present disclosure is distinctive on the basis that it has a corresponding built-in stretcher to receive a patient to be transferred and transported. It is built on a quadrangular frame that is distinctive because, while in resting position, it is located in a vertical arrangement coplanar to the rear face of the self-supporting structure. Fixed to the frame, a planar board with a removable pad onto which the patient will be laid down is provided.

This receiving stretcher is coupled to the self-supporting structure mounted on sliders whereby it may be arranged in said vertical position and moved until reaching a horizontal position on a plane lower than that corresponding to the frame of the lift, properly secured to the intermediate rails of said self-supporting structure.

In the preferred embodiments, for the movements that said receiving stretcher should perform, on the inner side faces of the rear columns of the supporting structure, vertical movement guides are defined, which are continuous with respective horizontal movement guides defined on the inner faces of said intermediate rails of the supporting structure.

On the lower sides of said quadrangular frame of this receiving stretcher, outwardly projecting bolts are defined, said bolts being housed in said vertical and horizontal movement guides of the self-supporting structure, which in combination with a pair of special sliding members supported on said intermediate rails allow the platform to rotate for guided and sustained movement from said vertical plane, horizontal plane, and vice versa.

Once arranged on the horizontal plane, fixing bolts are used to join the lower sides of the quadrangular frame and the intermediate rails of the self-supporting structure such that the stretcher can optimally withstand the obese patient's weight.

It is encompassed by the present disclosure that the structural frame include a reclinable section which, in association with an actuator (either pneumatic or equivalent), can be arranged at an angle of inclination to the horizontal plane, as in most hospital beds.

It is possible to recline or raise the bedhead to improve comfort and respiratory function of the patient, by raising or lowering the bedhead at 45°, through a mechanical means consisting of a special linear actuator acting on an arm associated with a transverse beam mounted in rotating condition. This beam integrates the front section of the frame on which the receiving stretcher is formed. Upon rotation thereof, the bedhead of the obese patient is raised, in accordance with the directions given by the nurse using the remote control.

It is also considered that at least one pair of wheels, on which the self-supporting structure is supported, be drive wheels associated with actuating means for propelling purposes.

There is no existing intrahospital stretcher or equivalent equipment that proposes, or even suggests, the constructive solution resulting from the description of the preceding paragraphs. For this reason, the proposed disclosure is not only novel but also clearly inventive.

Still other embodiments of the disclosure will become apparent upon a reading and understanding of the following detailed description.

BRIEF DESCRIPTION OF THE DRAWINGS

In order to achieve the aforementioned summarized advantages, to which users and persons of ordinary skill in the art will be able to add many more, and for the sake of better understanding the constructive, constitutive, and functional features of the intrahospital vehicle of the present disclosure, an example of a preferred embodiment is next described, which is schematically illustrated (not to scale) in the figures as follows.

It should be appreciated that, in all the figures, like reference numerals reference like or equivalent parts or elements forming the assembly, depending on the example chosen for the present explanation of the intrahospital vehicle of the present disclosure.

DETAILED DESCRIPTION OF THE DISCLOSURE

Figure 1:
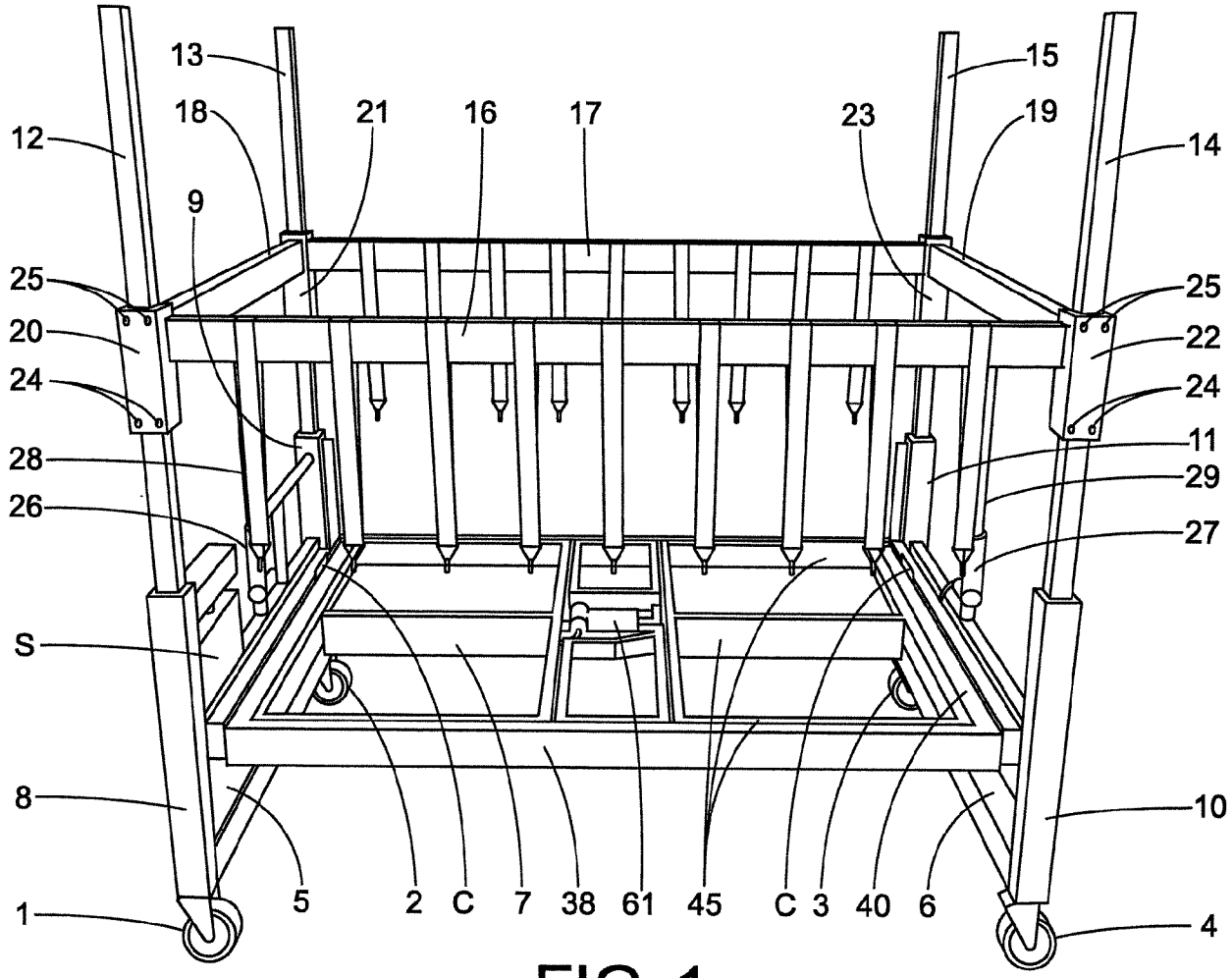
FIG. 1 is a perspective view showing the vehicle of the present disclosure, based on its general aspects as a whole, with the patient-receiving platform arranged in use position.

As it may be seen in the figures, the intrahospital vehicle of the present disclosure is built on a main structure mounted on rotatory-type wheels (1), (2), (3), and (4) to facilitate movement and maneuvering.

The main structure comprises a lower chassis formed by quadrangular plate profiles, defined by side rails (5) and (6) joined together by the rear crossbar (7).

Four corner columns are projected from said lower chassis, each of them comprising lower sections (8), (9), (10) and (11) extending into respective upper sections (12), (13), (14) and (15) which, being smaller than the lower sections, form the sliding track of a vertically movable lift created to cooperate in the process of transferring the obese patient.

As stated above, this lower chassis is distinctive because it is longer than any hospital bed, and it does not comprise any front crossbar; i.e., it is a plan chassis shaped as a lying "C", the sides of which would form side rails (5) and (6). Thus, the vehicle of the disclosure can transversely move forward, thus enclosing the bed on which the obese patient is lying, in order to arrange the lift over the same.

Indeed, the vertically movable lift comprises a quadrangular base frame formed by crossbars (16) and (17) that are joined together through side rails (18) and (19), with the particularity that, in correspondence with its corner vertices, they define respective hollow boxes (20), (21), (22) and (23) enclosing aforementioned upper sections (12), (13), (14) and (15) of the corner columns. These boxes include and support a pair of lower (24) and upper (25) transverse axes, carrying inner bearings supported on the flat faces defining said upper sections (12), (13), (14) and (15), thus allowing this lift to be able to vertically move in both senses.

For these vertical movements, the vehicle of the present disclosure uses electrical linear actuators (26) and (27) that actuate lifting means (28) and (29) that are extended between outer intermediate rails (30) and (31) in cooperation with lower sections (8), (9), (10) and (11) of the columns, and the above-mentioned side rails (18) and (19) of the lift.

This way, it is ensured that movements are smooth and accurate, while having the necessary power provided by said linear actuators (26) and (27) which may be commanded by the corresponding remote control.

Figure 3:
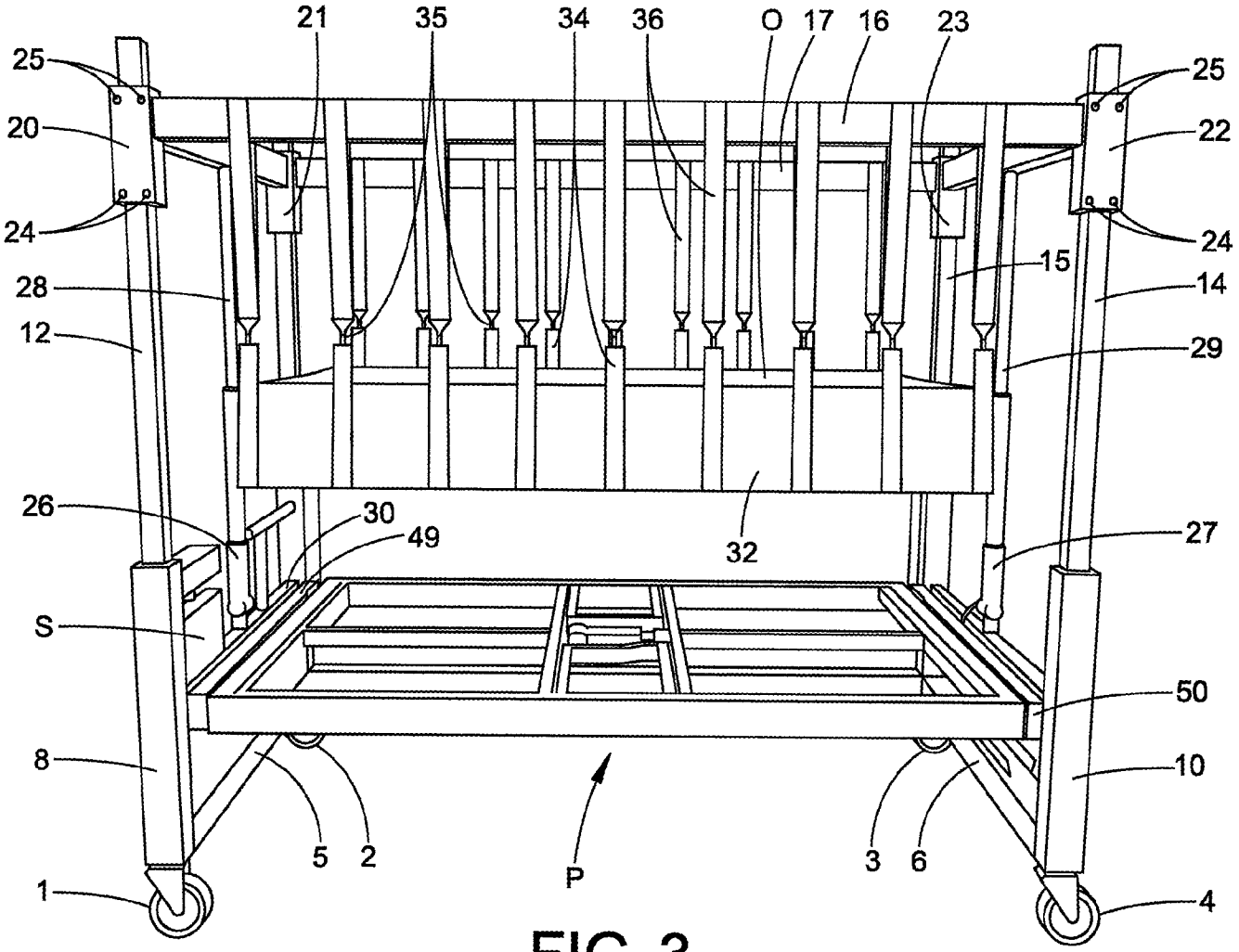
FIG. 3 is also a perspective view showing the vehicle of the present disclosure, based on its general aspects as a whole, in this case with the patient lifted and the patient-receiving platform arranged in use position.

It is possible to see especially in FIG. 3, that the lift described is provided to take the obese patient (0) from the bed and lift him up, keeping him in this position until the stretcher-bearer places and secures the receiving platform (P), after which the patient is lowered until he finally rests thereonto.

In this preferred embodiment, lift sheet (32) onto which patient (O) rests is fastened to crossbars (16) and (17) of the lift through anchor straps (34) that are passed through hooks (35) tied to the straps of the lift (36) hanging from crossbars (16) and (17).

Figure 2:
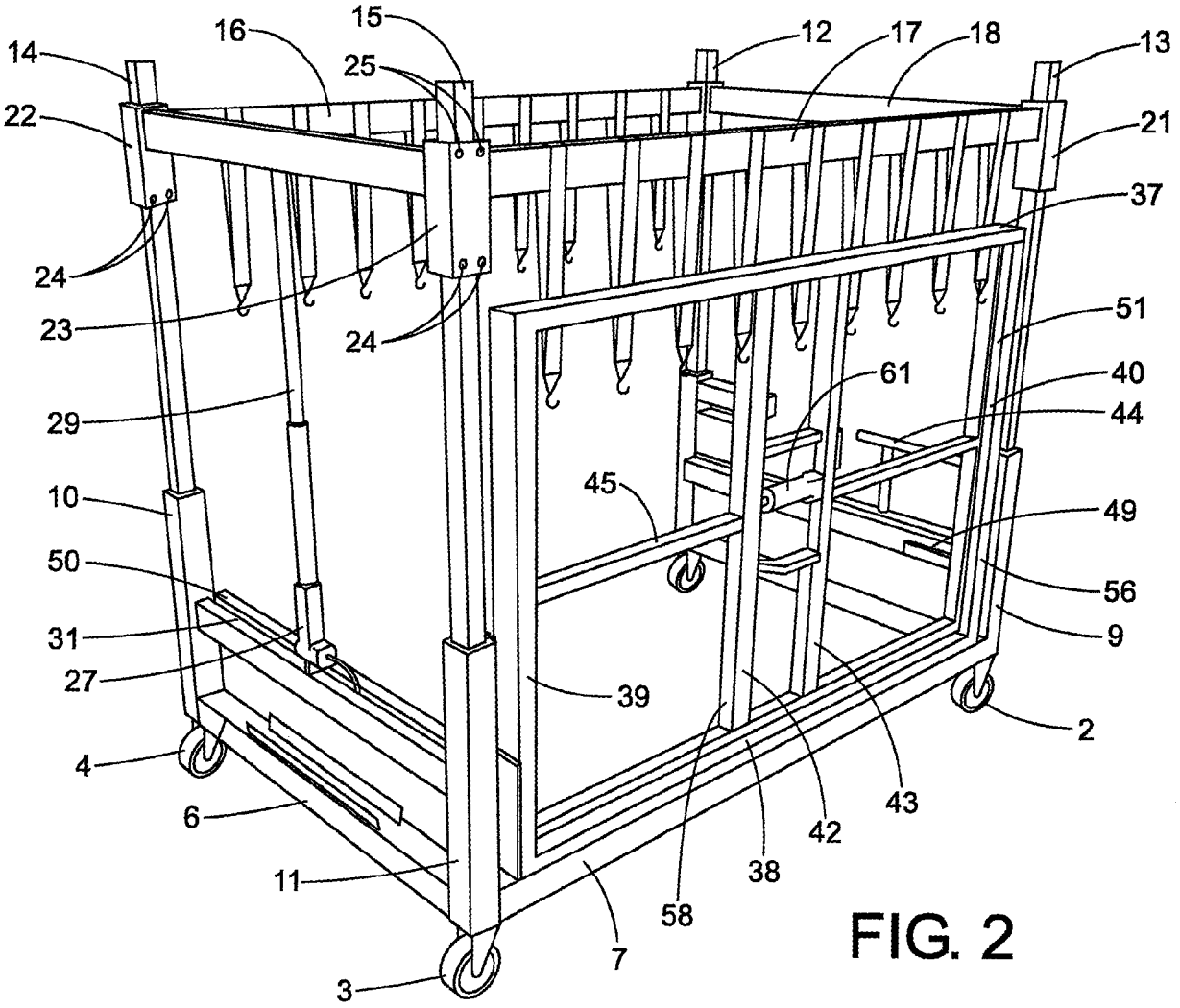
FIG. 2 is also a perspective view showing the vehicle of the present disclosure, based on its general aspects as a whole, in this case with the patient lifted and the patient-receiving platform arranged in resting position.

With reference now to FIG. 2, it is possible to observe that, on the rear face of the main structure, the vehicle of the present disclosure comprises a receiving stretcher that is arranged on a quadrangular base structural frame, also consisting of bent metal sheet profiles defining both crossbars (37) and (38) that remain joined together through side rails (39) and (40).

Figure 4:
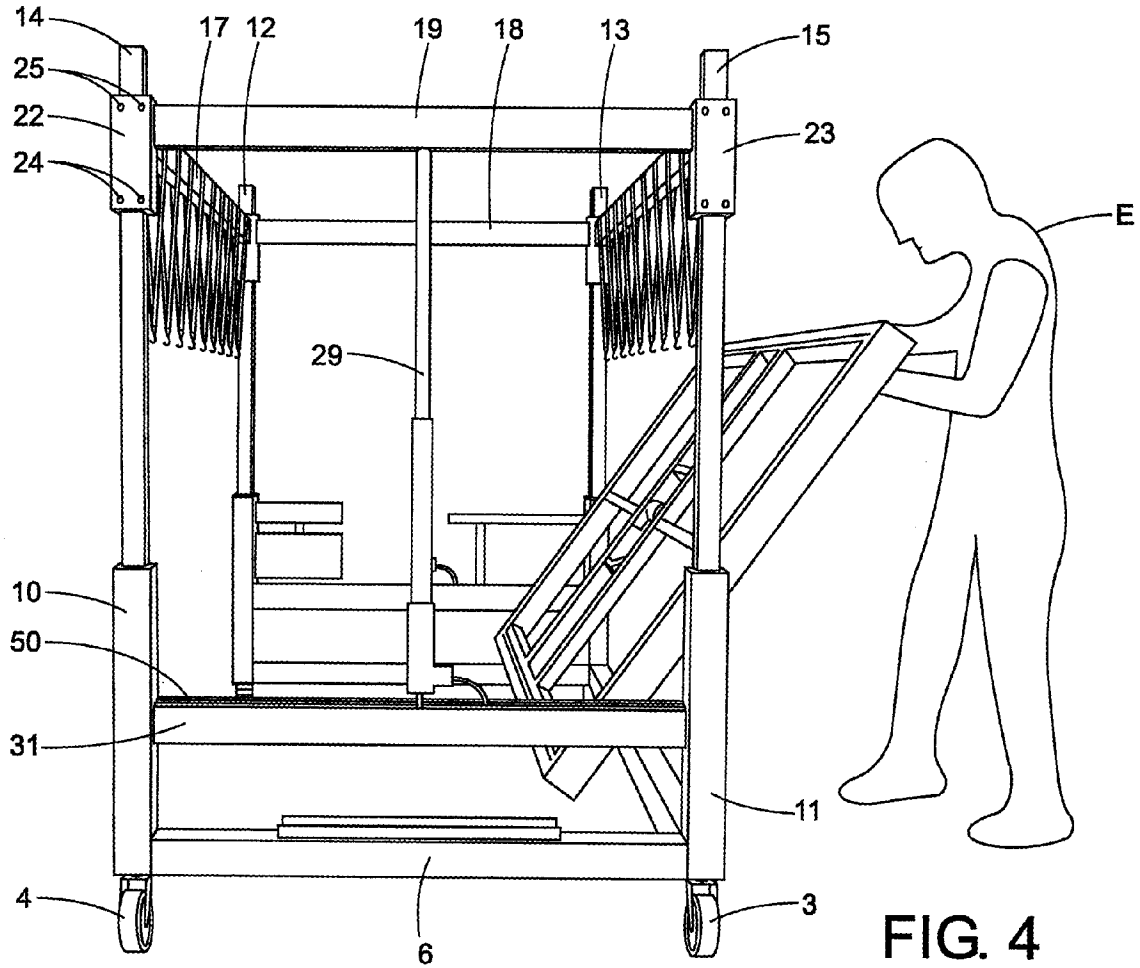
FIG. 4 is a perspective view showing the same vehicle from a side face, with an operator initiating movement of the patient-receiving platform from its resting position.
Figure 5:
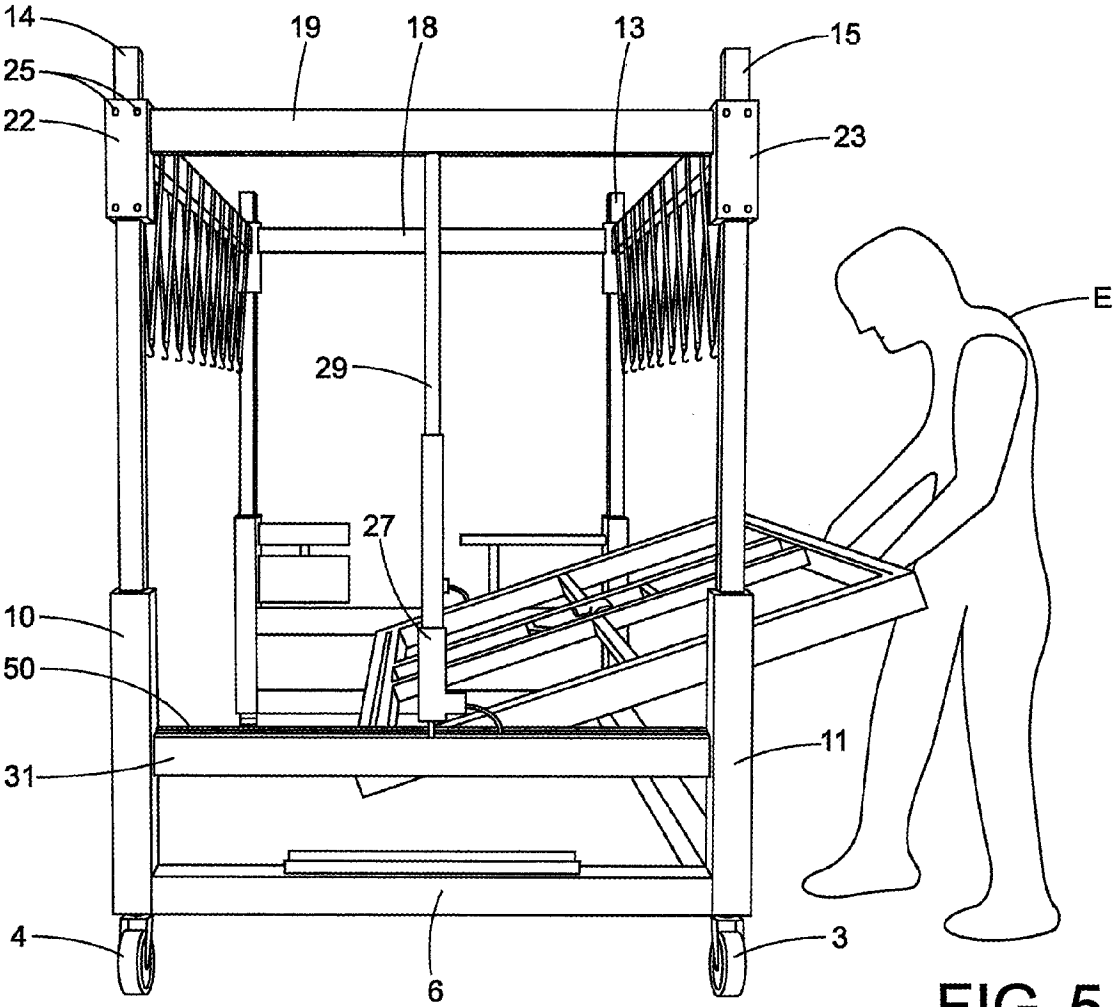
FIG. 5 is a perspective view showing the same vehicle from a side face, with an operator continuing moving the patient-receiving platform towards the horizontal plane such that is positioned to receive the patient.
Figure 6:
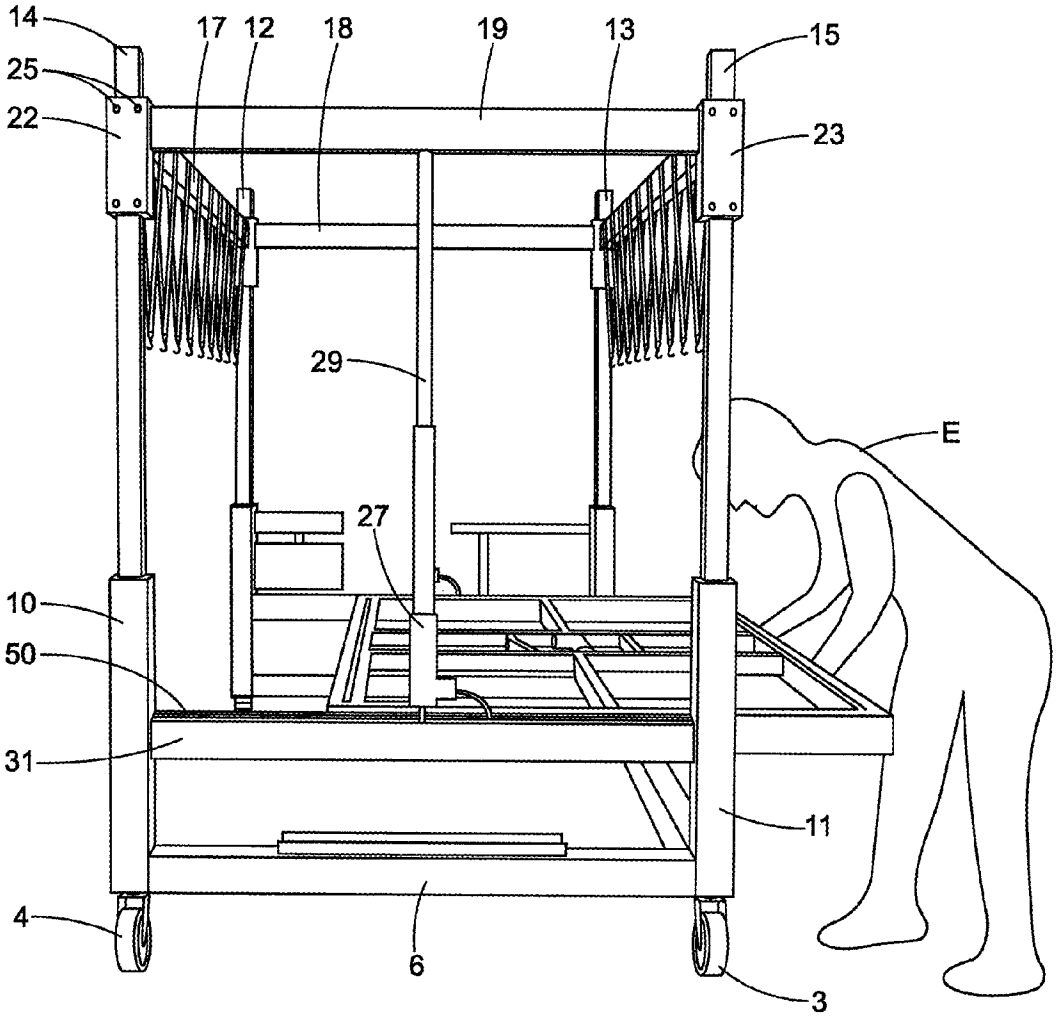
FIG. 6 is also a perspective view showing the same vehicle from a side face, in this case with the same operator moving the patient-receiving platform on an edge section in order to be arranged on a horizontal plane.

With particular reference to FIGS. 4, 5 and 6, it may be seen that this receiving stretcher has been designed to lie horizontally on the rear face of the vehicle, adopting the resting position (as represented in FIG. 2), and move from said position until reaching a horizontal plane (as shown in FIGS. 1, 3 and 6).

This is an assembly especially designed so that a stretcher-bearer or nurse (E) can proceed with movement from one position to the other, in an easy and straightforward manner, without any effort whatsoever.

Figure 7:
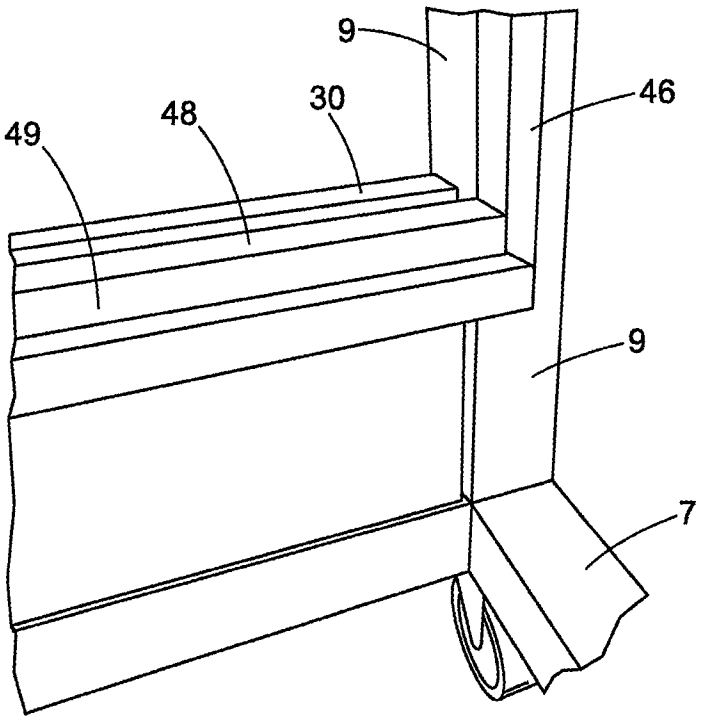
FIG. 7 is a perspective exploded view showing the guide defined on the vehicle structure for the purposes of moving the patient-receiving platform.

To this end, as especially shown in FIGS. 1 and 7, lower sections (9) and (11) of the columns of the main structure comprise respective vertically sliding guides (46) and (47) prolonged to define a horizontal section (48) (shown in FIG. 7) on inner intermediate rails (49) and (50) that are extended between said columns of the main structure, adjacent to outer intermediate rails (30) and (31).

Figure 10:
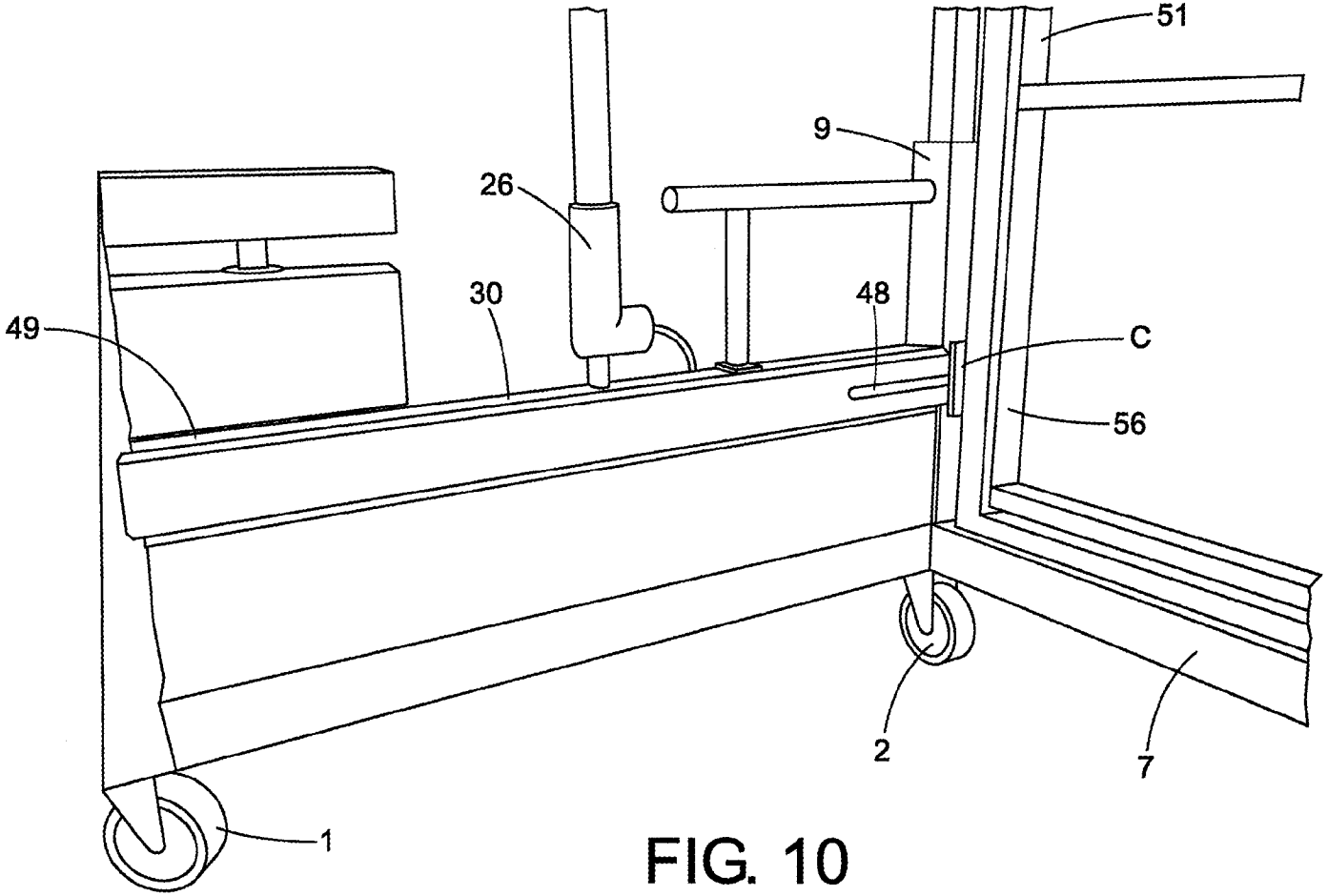
FIG. 10 is an exploded view showing how the patient-receiving platform is mounted on the vehicle structure.

In this guide, corresponding higher bolts (51) are housed and slid, said bolts projecting from side rails (39) and (40) of the structural frame (shown in FIGS. 2 and 10).

Furthermore, for sliding to be simple, smooth and straightforward, guiding members (C) of special construction have been incorporated, said guiding members created for the stretcher-bearer just to conduct movement with no effort whatsoever.

They are arranged each at one side of the stretcher (P) forming a pivoting slider that completes the guided movement mechanism to position said stretcher into vertical patient resting position, or horizontal patient supporting position.

Figure 8:
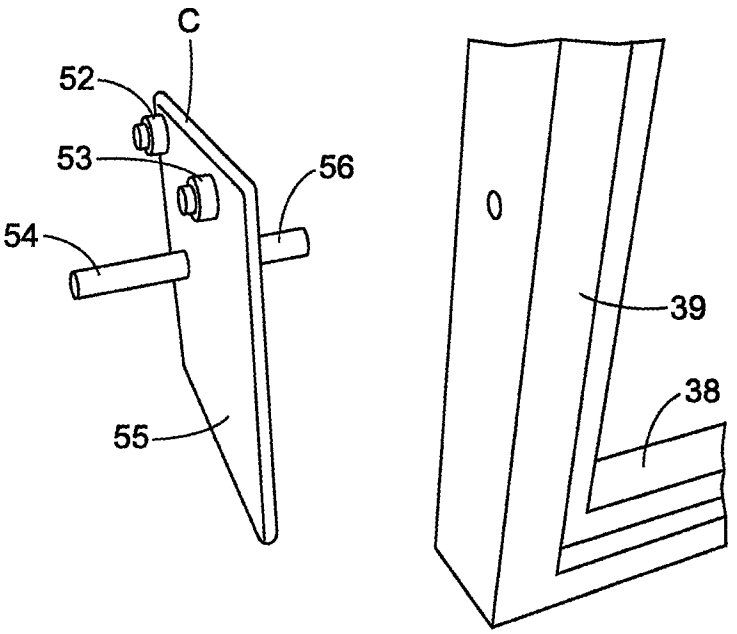
FIG. 8 is a perspective exploded view showing a sliding member used for moving the patient-receiving platform.
Figure 9:
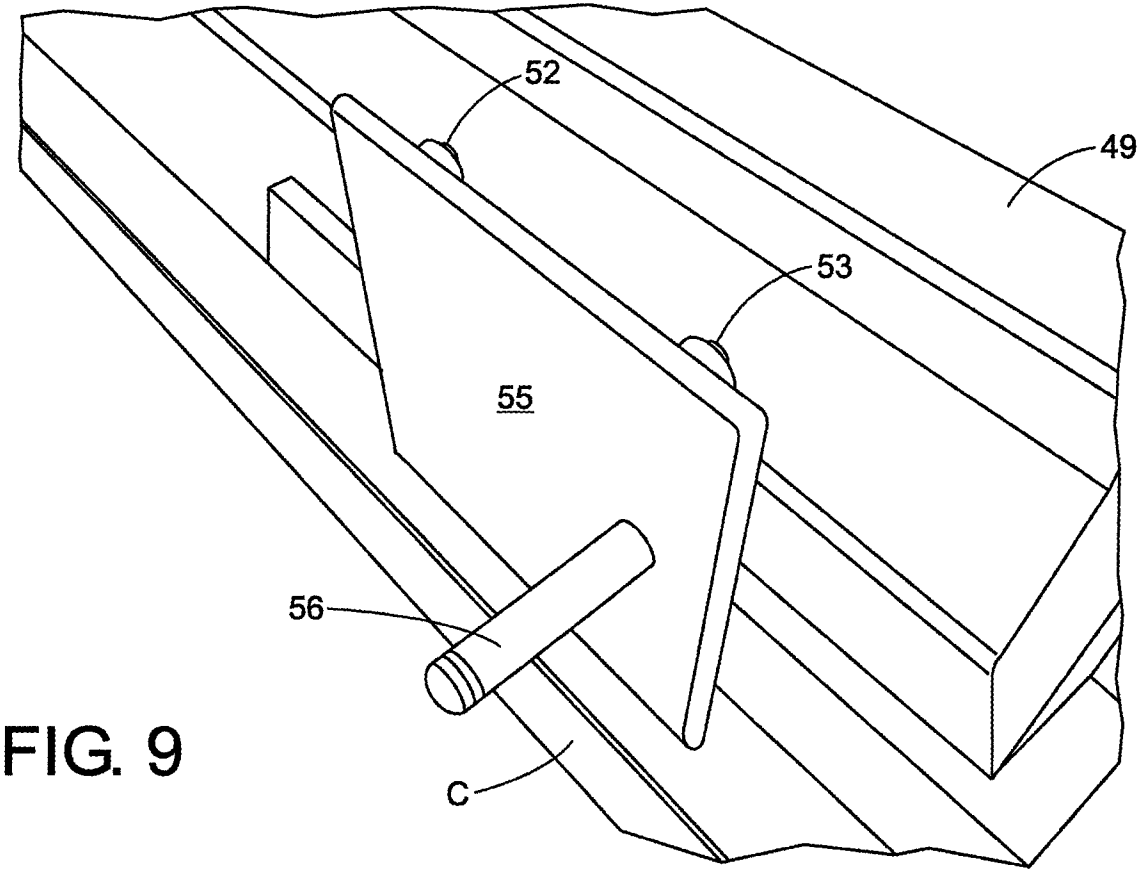
FIG. 9 is an exploded view showing how the sliding member of the preceding figure is arranged, supported on a chassis intermediate crossbar for movement thereof by guiding the patient-receiving platform.

Indeed, as shown in FIGS. 8, 9 and 10, each guiding member comprises a planar plate (55) which, from one face, projects a pair of wheels (52/53) provided to support onto the outer horizontal face of inner intermediate rails (49) and (50), and a bolt (54) (shown in FIG. 8), provided to dispose in front of the lower horizontal face of the same inner intermediate rails to avoid derailing.

On the opposite face of said plate (55), the same guiding member (C) projects pivoting axis (56) that is inferiorly positioned on each of side rails (39) and (40) of this receiving stretcher.

Once the stretcher is presented at its horizontal position (FIGS. 1 and 3), for stable anchoring, stable fixing bolts (57) are incorporated to transverse said side rails (39) and (40) and fixed to inner intermediate rails (49) and (50) of the main structure.

Figure 11:
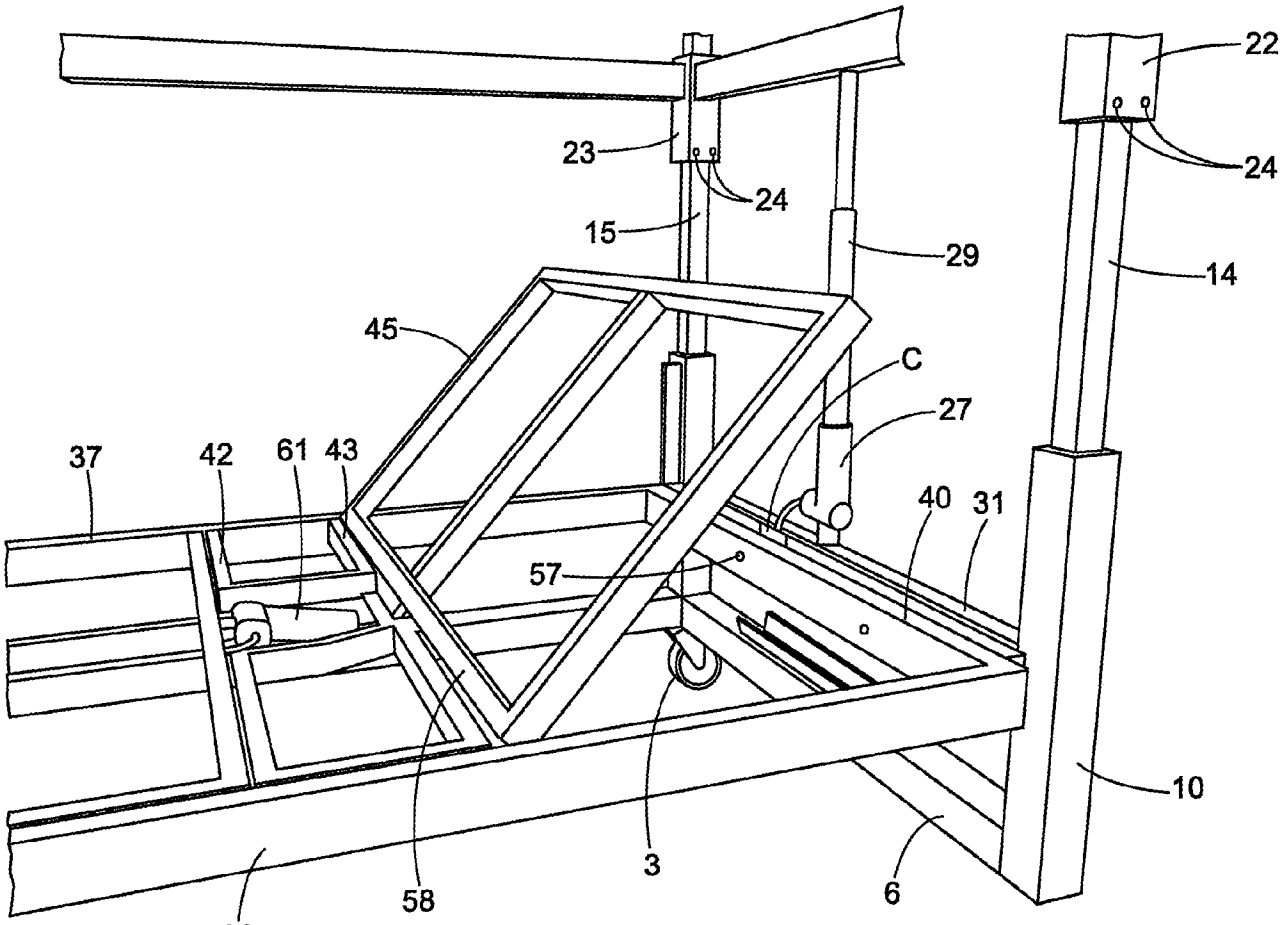
FIG. 11 is a perspective view showing the same patient-receiving platform in a constructive option that includes an adjustable inclination section.
Figure 12:
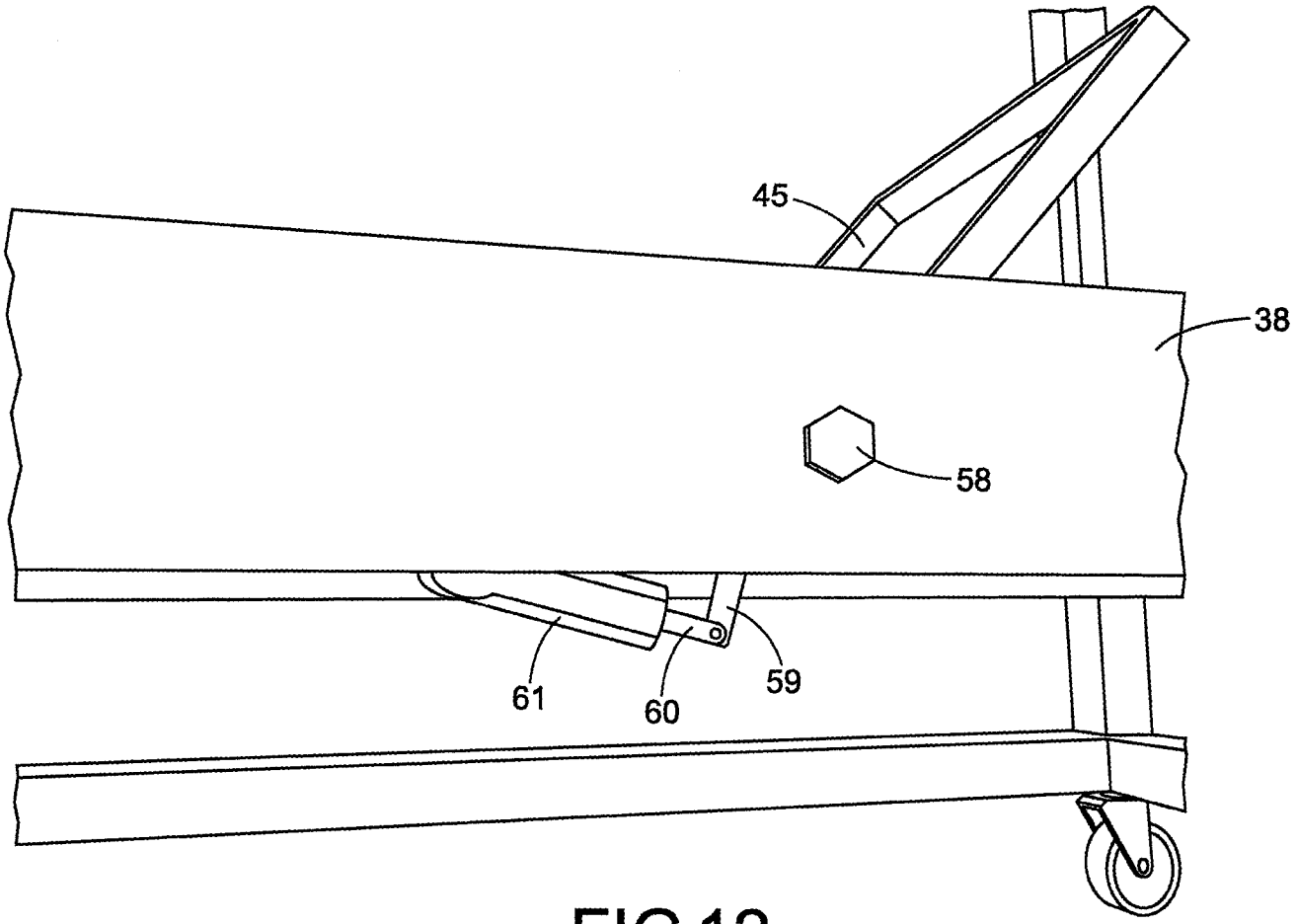
FIG. 12 is an exploded view showing a constructive option incorporated to mount the adjustable inclination section depicted in the preceding figure.

With reference now to FIGS. 1 and 2, as well as the details in FIGS. 11 and 12, it is possible to appreciate, in preferred embodiments of the structural frame defining the carrier stretcher, a fixed section incorporating profiles (42) and (43) that are fixed to crossbars (37) and (38), combined with short crossbar (44), with a reclinable portion formed by frame (45) the cylindrical crossbar (58) of which is an axis of rotation mounted on said crossbars (37) and (38).

As especially shown by the exploded view in FIG. 12, it is appreciated that, in cooperation with said axis of rotation (58) drive arm (59) is located, facing downwards and centrally disposed. Upon actuation of lift (60), which is commanded by electromechanical actuator (61), said arm produces movements allowing for selective inclination positions to the patient.

Finally, it is highlighted that, on the basis of reference (S), FIGS. 1 and 3 incorporate a small enclosure housing the integral electrical actuation system of the vehicle of the present disclosure, including a remote control that will be used by the stretcher-bearer or nurse for the required maneuvers. Said electrical system is not described for it is not considered to be within the scope of the present disclosure.

Having described the construction of the intrahospital vehicle of the present disclosure, said vehicle operates as outlined in the following steps:

1. While the patient is lying on the bed, the nurse shall place the lift sheet (32), and then actuate.

2. While the patient is still lying on the bed, with lift sheet (32) incorporated, the vehicle of the present disclosure comes closer advancing transversally until reaching a position that encloses the bed and the bedridden patient (O).

3. Thereafter, the nurse shall lower the lift by commanding its movement with the remote control until holding hooks (35) can pass through the loops of the straps (34) of the lift sheet. As a result, once all the hooks have been fastened, the obese patient is linked to the device.

4. The nurse shall actuate the same remote control so that linear actuators (27/28) can produce upward movement of the lift, separating and removing the patient from the bed, said patient being firmly held and suspended within the vehicle (FIG. 3).

5. Then the nurse shall move the vehicle away from its position over the bed with the patient in suspended position, and proceed to position the patient onto the receiving stretcher (P).

6. Previously, the nurse (E), shall secure the stretcher with both hands (as shown in FIGS. 4, 5 and 6) and move it smoothly from its vertical position to a horizontal position, all this with minimum effort thanks to the counterbalance of the stretcher and to guiding members (C) that facilitate maneuvering thereof.

7. Once said receiving stretcher is horizontally positioned, four fixing bolts (57) are introduced for the sake of immovability and resistance of the assembly.

8. Then the nurse (E), using the same remote control, shall command lowering of the lift until placing the patient to a position such that the patient rests on a soft pad of receiving stretcher (P) (FIG. 3), thus completing the transfer operation of the obese patient.

9. Once all these maneuvers have taken place, the patient will be in condition for being transported to the target location. Once there, the same maneuvers will have to be conducted in a reverse manner, that is, by lifting the patient up, moving the receiving stretcher to its vertical position, and making the vehicle advance until it is positioned over an operating table or the like, and then lowering the same, removing the fixing hooks from the loops of the lift sheet and remove the vehicle from the room.

10. Once the patient has been treated at the target location, the patient is moved away with the same vehicle of the present disclosure. To this end, the same transfer and movement maneuvers are conducted until the patient is returned to his hospital bed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An intrahospital vehicle for transport and transfer of obese patients designed to take a bedridden obese patient, lift the patient up and then lay the patient down onto a receiving stretcher to transfer the patient within a hospital, so that, once the target location has been reached, the patient may be transferred to an operating table, X-ray table, intensive care unit table or the like, and then transferred back to the receiving stretcher to return to the hospital bed, wherein said vehicle comprises a main rectangular base structure, mounted on wheels, said structure comprising a lower chassis formed by a rear crossbar and two side rails, from which four corner columns are projected, said columns forming respective guides for sliding a vertically movable lift, defined by a quadrangular base frame that is moved by pushing linear actuators while, on the rear face of the same main structure, a stretcher receiving the patient to be transferred and transported is arranged, said stretcher built on a structural frame that, at a resting position, is presented in vertical orientation, which may be moved until horizontally positioned on a plane lower than that of the frame of the lift, and then anchored to the intermediate rails of said main structure.

2. An intrahospital vehicle for transport and transfer of obese patients according to claim 1, wherein the lower chassis formed by side rails joined together by rear crossbar, defines a base in the shape of a lying "C", the dimension of which is larger than that of a conventional hospital bed.

3. An intrahospital vehicle for transport and transfer of obese patients according to claim 1, wherein the four corner columns projecting from the lower chassis comprise respective lower sections prolonging into respective upper sections which, being shorter than the lower sections, form the sliding track of the vertically movable lift.

4. An intrahospital vehicle for transport and transfer of obese patients according to claim 1, wherein the vertically movable lift is built on a quadrangular frame which, in correspondence with corner vertices of said frame, defines respective hollow boxes enclosing upper sections of the corner columns of the main structure, each of them housing pairs of lower and higher transverse axes, carrying respective inner bearings that are supported on the planar faces defining said columns, thus allowing for vertical movement in both senses.

5. An intrahospital vehicle for transport and transfer of obese patients according to claim 1, wherein actuators are electrical linear actuators that actuate lifting means, that extend between outer intermediate rails in cooperation with corner columns of the main structure, and side rails of the lift.

6. An intrahospital vehicle for transport and transfer of obese patients according to claim 1, wherein lift sheet onto which the patient is laid comprises anchor straps that are passed through hooks tied to straps hanging from crossbars of the quadrangular frame of the lift.

7. An intrahospital vehicle for transport and transfer of obese patients according to claim 1, wherein the rear corner columns of the main structure incorporate respective vertically sliding guides extending to define a horizontal section on inner intermediate rails of said structure, said guides housing and sliding corresponding higher bolts that project from crossbars of the receiving stretcher.

8. An intrahospital vehicle for transport and transfer of obese patients according to claim 1, wherein receiving stretcher is supported on the intermediate rails of the main structure, intercalating a pivoting slider defining the guided movement mechanism to position said stretcher into vertical patient resting position, or horizontal patient supporting position.

9. An intrahospital vehicle for transport and transfer of obese patients according to claim 8, wherein the pivoting slider uses a respective guiding member per each side of the stretcher, comprising a planar plate which, from one face, projects a pair of wheels provided to support on the higher horizontal face of the intermediate rails of the main structure, and a bolt provided to be in front of the lower horizontal face of said intermediate rails, while on the opposite face, said plate projects the pivoting axis inferiorly positioned on each of side rails of the receiving stretcher.

10. An intrahospital vehicle for transport and transfer of obese patients according to claim 1, wherein the stretcher is anchored to the intermediate rails of the main structure by means of through bolts.

* * * * *